US008424137B1

(12) United States Patent
Pearce et al.

(10) Patent No.: US 8,424,137 B1
(45) Date of Patent: Apr. 23, 2013

(54) RIBBED GEL

(75) Inventors: Tony M. Pearce, Alpine, UT (US); Terry V. Pearce, Alpine, UT (US)

(73) Assignee: Edizone, LLC, Alpine, UT (US)

( * ) Notice: Subject to any disclaimer, the term of this patent is extended or adjusted under 35 U.S.C. 154(b) by 0 days.

(21) Appl. No.: 12/287,057

(22) Filed: Oct. 3, 2008

Related U.S. Application Data

(60) Provisional application No. 61/004,460, filed on Nov. 27, 2007.

(51) Int. Cl.
*A47C 27/10* (2006.01)

(52) U.S. Cl.
USPC ..... 5/630; 5/632; 5/644; 5/652; 5/654; 5/655.5; 5/655.9; 5/653

(58) Field of Classification Search ..... 5/630, 632, 5/636, 644, 652, 654, 655.5, 655.9, 653
See application file for complete search history.

(56) References Cited

U.S. PATENT DOCUMENTS

| | | | | |
|---|---|---|---|---|
| 1,228,783 | A | 6/1917 | Kerivan | |
| 2,029,370 | A * | 2/1936 | Heldenbrand | 5/655.7 |
| 2,385,870 | A | 10/1945 | Walter et al. | |
| 2,458,588 | A | 1/1949 | Gordon et al. | |
| 2,491,557 | A | 12/1949 | Goolsbee | |
| 2,617,751 | A | 11/1952 | Bickett | |
| 2,655,369 | A | 10/1953 | Musilli | |
| 2,672,183 | A | 3/1954 | Forsyth | |
| 2,715,435 | A | 8/1955 | Rymland | |
| 2,814,053 | A | 11/1957 | Sevik | |
| 2,887,425 | A | 5/1959 | Holland | |
| 2,979,739 | A | 4/1961 | Krakauer | |
| 3,043,731 | A | 7/1962 | Hill | |
| 3,197,357 | A | 7/1965 | Schulpen | |
| 3,222,697 | A * | 12/1965 | Scheermesser | 428/160 |
| 3,308,491 | A * | 3/1967 | Spence | 5/676 |
| 3,407,406 | A | 10/1968 | Werner et al. | |
| 3,459,179 | A | 8/1969 | Olesen | |
| 3,462,778 | A | 8/1969 | Whitney | |
| 3,518,786 | A | 7/1970 | Holtvoigt | |
| 3,529,368 | A | 9/1970 | Canfield | |
| 3,552,044 | A | 1/1971 | Wiele | |
| 3,605,145 | A | 9/1971 | Graebe | |
| 3,748,669 | A | 7/1973 | Warner | |
| 3,748,779 | A | 7/1973 | Cherk et al. | |
| 3,801,420 | A | 4/1974 | Anderson | |
| 3,893,198 | A | 7/1975 | Blair | |
| 3,940,811 | A | 3/1976 | Tomikawa et al. | |

(Continued)

FOREIGN PATENT DOCUMENTS

| | | |
|---|---|---|
| EP | 0614622 A1 | 9/1994 |
| GB | 1106958 | 3/1968 |

(Continued)

OTHER PUBLICATIONS

Walker, Benjamin M., et al., Handbook of Thermoplastic Elastomers, Second Edition, 1988, pp. 26-28, Van Nostrand Reinhold Company, Inc., New York, New York.
Provisional U.S. Appl. No. 61/039,259, filed Mar. 25, 2008, 26 pages.
International Search Report and Written Opinion for International Application No. PCT/US2010/035587, Publication No. WO 2010/135542, mailed Jan. 3, 2011 (7 pages).

(Continued)

*Primary Examiner* — William Kelleher
(74) *Attorney, Agent, or Firm* — TraskBritt

(57) ABSTRACT

Ribbed gel devices for cushioning purposes.

18 Claims, 2 Drawing Sheets

U.S. PATENT DOCUMENTS 3,968,530 A 7/1976 Dyson
3,986,213 A 10/1976 Lynch
4,038,762 A 8/1977 Swan, Jr.
4,083,127 A 4/1978 Hanson
4,144,658 A 3/1979 Swan, Jr.
4,163,297 A 8/1979 Neumark
4,229,546 A 10/1980 Swan, Jr.
4,243,754 A 1/1981 Swan, Jr.
4,247,963 A 2/1981 Reddi
4,252,910 A 2/1981 Schaefer
4,255,202 A 3/1981 Swan, Jr.
4,256,304 A 3/1981 Smith et al.
4,274,169 A 6/1981 Standiford
4,279,044 A 7/1981 Douglas
4,292,701 A 10/1981 Woychick
4,335,476 A 6/1982 Watkin
4,369,284 A 1/1983 Chen
4,370,769 A 2/1983 Herzig et al.
4,378,396 A 3/1983 Urai et al.
4,383,342 A * 5/1983 Forster ..... 5/731
4,422,194 A 12/1983 Viesturs et al.
4,457,032 A 7/1984 Clarke
4,467,053 A 8/1984 Markle
4,472,847 A 9/1984 Gammons et al.
4,483,029 A 11/1984 Paul
4,485,505 A 12/1984 Paul
4,485,568 A 12/1984 Landi et al.
4,498,205 A 2/1985 Hino
4,541,136 A 9/1985 Graebe
4,572,174 A 2/1986 Eilender et al.
4,588,229 A 5/1986 Jay
4,614,632 A 9/1986 Kezuka et al.
4,618,213 A 10/1986 Chen
4,628,557 A 12/1986 Murphy
4,660,238 A 4/1987 Jay
4,670,925 A 6/1987 Carussi et al.
4,686,724 A 8/1987 Bedford
4,698,864 A 10/1987 Graebe
4,709,431 A 12/1987 Shaktman
4,713,854 A 12/1987 Graebe
4,726,624 A 2/1988 Jay
4,728,551 A 3/1988 Jay
4,737,998 A 4/1988 Johnson, Sr.
4,744,564 A 5/1988 Yamada
4,761,843 A 8/1988 Jay
4,842,330 A 6/1989 Jay
4,913,755 A 4/1990 Grim
4,945,588 A 8/1990 Cassidy et al.
4,952,190 A 8/1990 Tarnoff et al.
4,952,439 A 8/1990 Hanson
4,953,913 A 9/1990 Graebe
4,959,059 A 9/1990 Eilender et al.
4,967,433 A * 11/1990 Neal ..... 5/655.9
5,010,608 A 4/1991 Barnett et al.
5,015,313 A 5/1991 Drew et al.
5,018,790 A 5/1991 Jay
5,020,176 A 6/1991 Dotson
5,027,801 A 7/1991 Grim
5,039,567 A 8/1991 Landi et al.
5,052,068 A 10/1991 Graebe
5,053,436 A 10/1991 Delgado
5,058,291 A 10/1991 Hanson
5,074,620 A 12/1991 Jay et al.
5,079,786 A 1/1992 Rojas
5,079,787 A 1/1992 Pollman
5,093,138 A 3/1992 Drew et al.
5,100,712 A 3/1992 Drew et al.
5,103,518 A 4/1992 Gilroy et al.
5,111,544 A 5/1992 Graebe
5,147,685 A 9/1992 Hanson
5,149,173 A 9/1992 Jay et al.
5,152,023 A 10/1992 Graebe
5,153,956 A * 10/1992 Nold ..... 428/218
5,163,196 A 11/1992 Graebe et al.
5,171,766 A 12/1992 Mariano et al.
5,172,494 A 12/1992 Davidson
5,180,619 A 1/1993 Landi et al.
5,190,504 A 3/1993 Scatterday
5,191,752 A 3/1993 Murphy
5,201,780 A 4/1993 Dinsmoor, III et al.
5,203,607 A 4/1993 Landi
5,204,154 A 4/1993 Drew et al.
5,211,446 A 5/1993 Jay et al.
5,243,722 A 9/1993 Gusakov
5,255,404 A 10/1993 Dinsmoor, III et al.
5,262,468 A 11/1993 Chen
5,282,286 A 2/1994 MacLeish
5,289,878 A 3/1994 Landi et al.
5,314,735 A 5/1994 Kronberg
5,330,249 A 7/1994 Weber et al.
5,334,646 A 8/1994 Chen
5,334,696 A 8/1994 Olson et al.
5,335,907 A 8/1994 Spector
5,336,708 A 8/1994 Chen
5,352,023 A 10/1994 Jay et al.
5,360,653 A 11/1994 Ackley
5,362,834 A 11/1994 Schapel et al.
5,369,828 A 12/1994 Graebe
5,403,642 A 4/1995 Landi et al.
5,421,874 A 6/1995 Pearce
5,429,852 A 7/1995 Quinn
5,444,881 A 8/1995 Landi et al.
5,445,861 A 8/1995 Newton et al.
5,452,488 A * 9/1995 Reinhardt ..... 5/729
5,456,072 A 10/1995 Stern
5,490,299 A 2/1996 Dinsmoor, III et al.
5,496,610 A 3/1996 Landi et al.
5,508,334 A 4/1996 Chen
5,513,402 A * 5/1996 Schwartz ..... 5/691
5,549,743 A 8/1996 Pearce
5,592,706 A 1/1997 Pearce
5,617,595 A 4/1997 Landi et al.
5,626,657 A 5/1997 Pearce
5,633,286 A 5/1997 Chen
5,636,395 A 6/1997 Serda
5,689,845 A 11/1997 Sobieralski
5,749,111 A 5/1998 Pearce
5,881,409 A 3/1999 Pearce
5,994,450 A 11/1999 Pearce
6,026,527 A 2/2000 Pearce
6,115,861 A 9/2000 Reeder et al.
6,187,837 B1 2/2001 Pearce
6,241,695 B1 * 6/2001 Dabir ..... 601/136
6,413,458 B1 7/2002 Pearce
6,498,198 B2 12/2002 Pearce
6,598,321 B2 7/2003 Crane et al.
6,704,961 B2 * 3/2004 Kienlein ..... 5/730
6,797,765 B2 9/2004 Pearce
6,865,759 B2 3/2005 Pearce
6,905,831 B2 6/2005 Jiang et al.
6,908,662 B2 6/2005 Pearce
7,060,213 B2 6/2006 Pearce
7,076,822 B2 7/2006 Pearce
7,138,079 B2 11/2006 Pearce
7,666,341 B2 2/2010 Pearce
7,730,566 B2 6/2010 Flick et al.
2004/0172766 A1 9/2004 Formenti
2005/0223667 A1 10/2005 McCann et al.
2006/0194925 A1 8/2006 Pearce
2006/0260061 A1 * 11/2006 Jansen ..... 5/710
2007/0246157 A1 10/2007 Mason et al.
2009/0246449 A1 10/2009 Jusiak
2010/0227091 A1 9/2010 Pearce
2010/0229308 A1 9/2010 Pearce et al.

FOREIGN PATENT DOCUMENTS

GB 1261475 1/1972
GB 2150431 A 7/1985
KR 20-0315625 6/2003
KR 20-0380271 3/2005
KR 10-2007-0026934 3/2007
WO 88/10339 A1 12/1988
WO 91/04290 A1 4/1991
WO 92/14387 A1 9/1992
WO 96/39065 A1 12/1996
WO 97/17001 A1 5/1997
WO WO 2004080245 A1 * 9/2004

OTHER PUBLICATIONS

International Search Report and Written Opinion for International Application No. PCT/US2010/035602, Publication No. WO 2010/135550, mailed Dec. 22, 2010 (8 pages).

International Search Report and Written Opinion for International Application No. PCT/US2010/035635, Publication No. WO 2010/135565, mailed Dec. 27, 2010.

* cited by examiner

RIBBED GEL

PRIORITY CLAIM

This patent application claims priority to, and the benefit of the filing date of U.S. Provisional Patent Application Ser. No. 61/004,460, filed on Nov. 27, 2007, which is hereby incorporated by reference in its entirety.

BACKGROUND

The subject matter hereof relates to gel cushioning elements.

SUMMARY

Various gel cushioning elements can be constructed for cushioning purposes, as illustrated and explained herein.

DETAILED DESCRIPTION

Figure 1A:
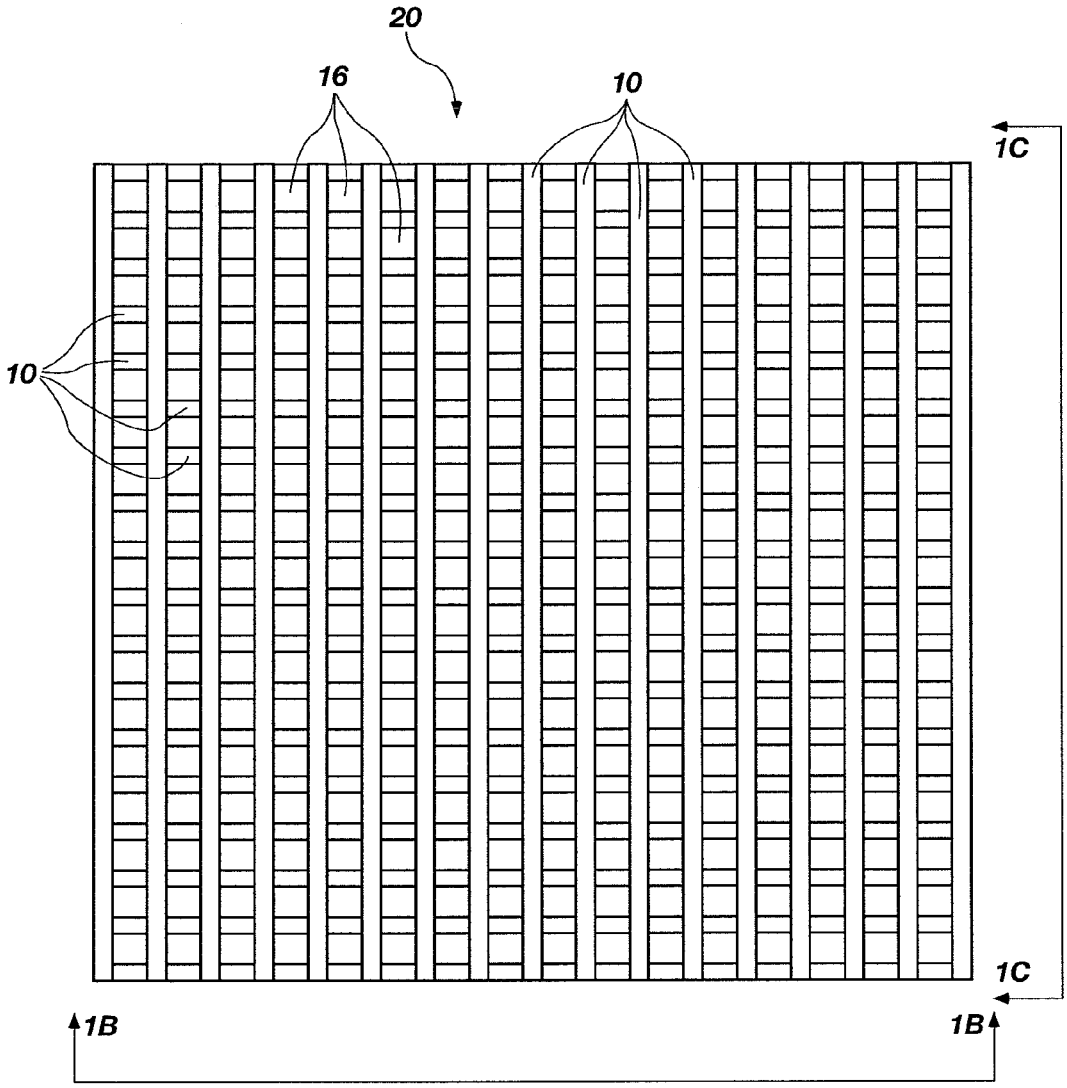
FIGS. 1A, 1B, and 1C depict an example embodiment of ribbed gel.

Ribbed gel may be used in an unlimited number of cushioning applications. Ribbed gel provides significant space within the cushion for the ribs to either buckle or to substantially move and/or deform without substantially increasing the overall size and shape of the overall cushioning element. "Substantially move and/or deform" is herein used to mean the ability to exhibit sufficient movement or deformation to touch the adjacent rib and/or the ability to fill a portion of the space between ribs in the adjacent layer of ribs.

In the case of buckling ribs, ribs are designed to buckle at a predetermined pressure threshold, and this buckling can relieve pressure hot spots and redistribute pressure so that no part of the cushioned object receives pressure above the predetermined threshold. Buckling of an elongated rib can have similar cushioning benefits as buckling of a shared-wall hollow column as described in U.S. Pat. Nos. 5,749,111 and 6,026,527, which are hereby incorporated herein by this reference in their entirety. Unlike the shared-wall hollow-column buckling cushioning elements described in the '111 and '527 patents, however, the ribs are solid elongated members. These solid elongated members, or ribs, can often fit into small cushioning areas with greater effect than shared-wall hollow columns, such as in the thin confines required for a shoe insole. The ribbed members of the instant invention also allow greater shear movement than the shared-wall hollow columns of the '111 and '527 inventions, which are somewhat reinforced against shear by their natures, and this increased shearability is advantageous in many cushioning applications.

In the case of ribs that do not buckle but due to the spacing between ribs are allowed to substantially deform or move without substantially changing the size or shape of the overall cushioning element, the ribs are designed and the material is formulated to allow significant deformation, which deformation takes place in the gaps between ribs, and even in the gaps between ribs of the next layer up or down that are at a different angle. A principle advantage of ribbed gel, with its two layers at an angle to each other, is the combination of cushioning (pressure relief and shear relief, whether from buckling or other significant deformation or movement) and stability (via the attachment at multiple points on each rib to the ribs above or below).

The ribbed gel described herein may be made in whole or in part from a gel or other desired material. By "gel" is meant an elastomeric gel such as a solid elastomer extended by at least 20 parts plasticizer per 100 parts solid elastomer by weight (20:100). The elastomer could be a styrene-ethylene-ethylene-propylene-styrene (SEEPS), styrene-ethyl-butylene-styrene (SEBS), or styrene-ethylene-propylene-styrene (SEPS) elastomer, or other elastomer, as desired. In some instances, the solid elastomer is extended to at least 50:100 and most preferably by at least 100:100. Some acceptable gels are disclosed in U.S. Pat. Nos. 7,060,213; 7,076,822; 6,908,662; 6,865,759; 6,797,765; 6,498,198; 6,413,458; 6,187,837; 6,026,527; 5,994,450, each of which is hereby incorporated by reference in its entirety.

A useful gel is KRATON® E1830 elastomer made by Kraton Polymers, Inc., extended by white food grade mineral oil such as CARNATION® oil. Another useful gel is SEPTON® 4055 elastomer made by Septon USA and Kuraray, extended by CARNATION® oil or other white food grade mineral oil. Other useful gels include polyurethane-based gels, silicone-based gels, polyvinylchloride-based (PVC-based) gels, acrylic-based gels, and many others.

The products and processes herein can also utilize non-gel elastomers in place of the gel elastomers described, but in many cases, describe the product as including gel by way of example and for simplicity, but not by way of limitation of the bounds of the invention. For example, instead of gel elastomer, the elastomer can be any of the following: rubber, thermoplastic elastomer, PVC, synthetic rubber, polyurethane, polyurethane film, polyurethane foam, polyurethane memory foam, foamed gel, latex rubber, synthetic latex rubber, latex foam rubber, latex foam, polyolefin, foamed polyolefin (including but not limited to foamed polyethylene), or any other flexible or elastic material. We have discovered that the optional addition of hollow microspheres not only lightens the gel and reduces cost, but also can aid the manufacturing process by changing the characteristics of the gel in the melted or liquid phase. We have discovered that foaming the gel (open cell or closed cell foam) can also be advantageous in reducing weight and/or material cost.

A preferred material is elastomeric gel, which is defined herein as an elastomer material with at least 15% by weight plasticizer. Gel is the preferred material because it has the "feel" that is desired in many cushions such as mattresses, seat cushions, shoe insoles, and the like. Gel is able to buckle with more agility than stiffer elastomers, sometimes forming multiple curves during buckling where a stiffer elastomer may simply fold and thus not give a gradual buckling "failure," or refusing to buckle at typical cushioning pressures when manufactured at reasonable wall thicknesses. Gel also provides cushioning without buckling but instead, through deformation and movement, is able to flow to shape around a cushioned object. If gel is used, the resultant pressure peak on the cushioned object will be less than on a cushion with a harder elastomer that will not flow around a cushioned object and does not easily move into the space between the ribs that are adjacent, above or below.

Nonetheless, although the word "gel" is used in the naming of the invention because it is preferred in many cushioning applications, the present invention applies to non-gel elastomers and/or higher-durometer elastomers, such as cross-linked latex rubber, cross-linked and non-cross-linked synthetic elastomers of many types (SANTOPRENE® of any grade, KRATON® of any grade, SEPTON® of any grade, isoprene, butadiene, silicone rubber, thermoset or thermoplastic polyurethane and many others). For simplicity, the elastomer will be referred to as "gel" hereafter.

There are numerous types of gels that would work as the material from which the present invention is made, including silicone/plasticizer gels, polyurethane/plasticizer gels, acrylic/plasticizer gels, plasticized block copolymer elastomer gels, and others. Certain types of plasticized block copolymer gels are preferred because they are less tacky, bleed or wick out less plasticizer, have greater tensile, compression, shear and tear strengths, and do not exhibit permanent deformation after being stressed repeatedly or long term in typical human cushioning situations. The two most preferred gels for most applications of ribbed gel are:

(a) SEPTON® 4055, a high Mw SEEPS tri-block copolymer elastomer, melt blended with white paraffinic mineral oil with no or low naphthenic content, such as CARNATION® oil. The durometer can be adjusted to the specific configuration and application (for example, to provide the correct buckling pressure threshold for a given design) by adjusting the ratio of SEEPS to oil. The higher the ratio, the higher the durometer. A more complete description can be found in U.S. Pat. No. 5,994,450, which is hereby incorporated herein by this reference. While non-limiting as an example, many cushions do well with this preferred gel in a ratio of between 150 and 800 parts by weight of mineral oil to 100 parts of SEPTON® 4055. Cushions such as mattresses and seat cushions can be advantageously made with this preferred gel in a ratio of between 250 and 500 parts by weight of mineral oil to 100 parts of SEPTON® 4055.

(b) KRATON® E1830, a SEBS tri-block copolymer elastomer in which the EB midblock has a wide range of Mw, the average being a high Mw, melt blended with white paraffinic mineral oil with no or low naphthenic content, such as CARNATION® oil. The durometer can be adjusted to the specific configuration and application (for example, to provide the correct buckling pressure threshold for a given design) by adjusting the ratio of SEBS to oil. The higher the ratio, the higher the durometer. A more complete description can be found in U.S. Patent Application Publication No. 20060194925, now U.S. Pat. No. 7,964,664, issued Jun. 21, 2011, which is incorporated by reference. While non-limiting as an example, many cushions do well with this preferred gel in a ratio of between 100 and 700 parts by weight of mineral oil to 100 parts of KRATON® E1830. Cushions such as mattresses and seat cushions can be advantageously made with this preferred gel in a ratio of between 150 and 450 parts by weight of mineral oil to 100 parts of KRATON® E1830.

Another preferred gel is made by taking the two preferred gels above and replacing part of the mineral oil with resin, such as REGALREZ®, of various varieties that are solid at the use temperature of the cushion, or replacing all of the mineral oil with resin that is liquid at the use temperature of the cushion, such as REGALREZ® 1018. The ultra-viscous resin causes the resultant gel to have a slow rebound, preferable for some cushioning applications.

For example, if 1600 parts of REGALREZ® 1018 is used as the plasticizer with 100 parts of SEPTON® 4055, a soft, slow-rebound gel results at room temperature. REGALREZ® 1018 is a highly viscous fluid at room temperature. Alternatively, in that example formula, the REGALREZ® 1018 can be replaced with a mixture of mineral oil and any of the REGALREZ® products that are solid (usually sold in chip form) at room temperature. Such a slow-rebound gel will have less temperature-related changes of durometer and rebound rate within the human comfort zone of temperatures than will a gel based on REGALREZ® 1018 as the sole plasticizer, which has a viscosity that is very changeable with temperature in the human comfort range.

One problem with the use of such slow-rebound resin-plasticized gels is that most formulations will result in a very tacky or even adhesively sticky gel. So, when the ribs buckle and touch one another, they would stick together and not release when the cushioned object is removed. This can be corrected by coating the surface of the sticky gel with a material that sticks to the sticky gel but is not itself sticky. Advantageous materials, given as examples and not by way of limitation, are microspheres and Rayon (velvet) flocking fibers. For example, microspheres stick very well to the tacky gel and do not come off and, thus, the surface of the gel is rendered tack-free because the outer surface now consists of the outer surface of millions of non-tacky microspheres.

As another example, tiny Rayon (velvet) flocking fibers stick very well to the tacky gel and do not come off and, thus, the surface of the gel is rendered tack-free because the outer surface now consists of the outer surface of thousands of non-tacky short fibers. A third example is to put a thin skin of polyurethane elastomer onto the tacky gel, either by use of a thermoplastic polyurethane film, or by coating the tacky gel in an aqueous dispersion of polyurethane and allowing it to dry.

Ribbed gel made with slow rebound elastomers will have a different feel than ribbed gel made with the other preferred gels. Such slow-rebound ribbed gel will be very compatible, for example, with memory foams in a mattress or seat cushion, because the memory foam is also slow-rebound in nature.

Figure 1B:
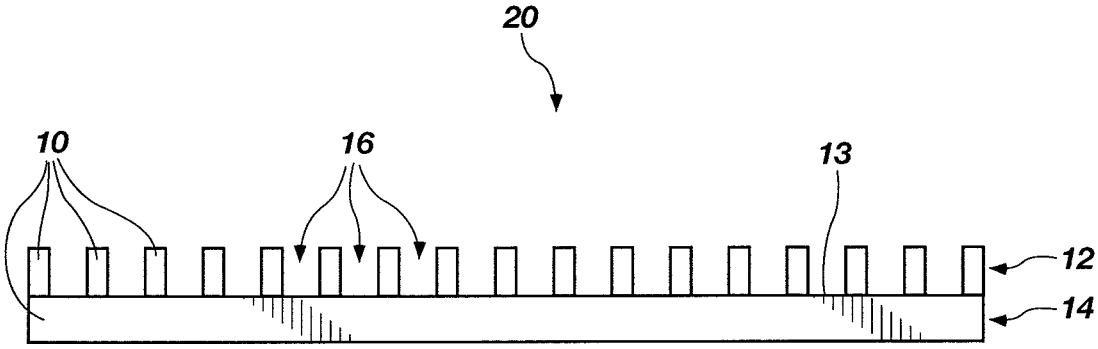
Figure 1C:
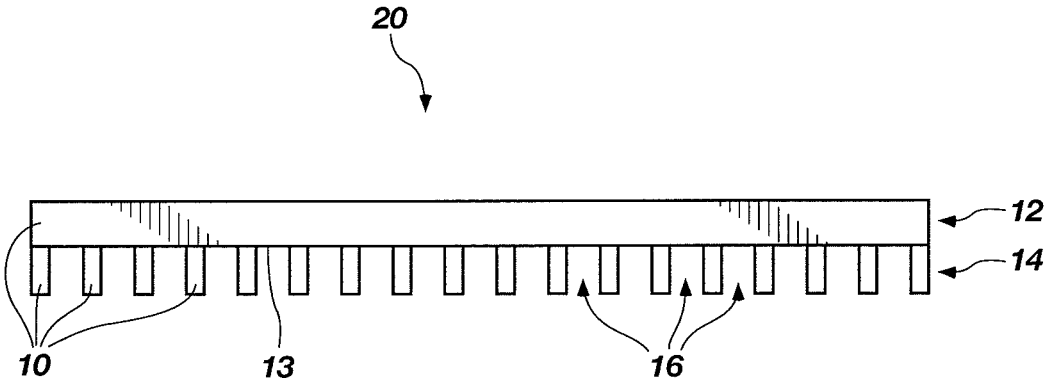

Referring to FIGS. 1A through 1C, ribbed gel utilizes at least two layers 12, 14 of gel one atop the other, with the pattern in the top portion running at an angle to the pattern in the bottom portion, and the two layers 12, 14 joined at the points on the interface layer where they intersect. This joining can either be through an integral joint of like material or through adhesive bonding or through fusing the tops of the bottom ribs 10 to a fabric 13 and also fusing the bottoms of the top ribs 10 to the same fabric 13, or by other joining methods. Any of these may be referred to as a "fused" joint. In an integral joint, the first ribbed gel cushioning element and the second ribbed gel cushioning element are integrally formed with one another such that they comprise regions of a single unitary body. Each top rib integrally adjoins at least one of the bottom ribs over a generally planar area in a plane of intersection between the layers 12, 14. The generally planar area is defined by a width of each of the integrally adjoining ribs. FIGS. 1A, 1B and 1C depict an example of cushioning member 20 that includes two layers 12, 14 of ribs 10 of gel at 90 degrees to one another.

Ribbed gel has a unique feel and functionality. Each angle of patterned gel (such as in the example) may provide stability in one direction and instability (buckling for example) in the other direction. Or, the ribs 10 of both directions (the top ribs 10 and the bottom ribs 10) can both be unstable or both be stable. In the case where both layers 12, 14 of ribs 10 are stable, the ribs 10 must be capable of substantial movement or deformation into the spaces 16 between the ribs that are adjacent, above or below. Even if the members (such as ribs 10) are not tall enough to buckle, the spaces 16 between the ribs 10 and the spaces in the pattern below or above give the gel room to move during cushioning, which is critical to gel being able to fully conform to the cushioned object. Because of the opposing angles of the patterns and the many connections on each rib 10 to the ribs 10 in the other layer 12, 14, conformability can be achieved in one or both directions while stability exists in the overall cushioning member 20.

In some embodiments of ribbed gel, a fabric 13 is fused into the gel. It can be top and/or bottom, and sometimes it can be right at the interface between the two layers 12, 14. Top or bottom fabrics provide bondability and breathability. Center fabrics 13 can provide sought-after properties such as in-plane stiffness or dimensional control.

It takes energy to buckle and pop back up, and this energy helps absorb shocks and attenuate vibrations. It also takes energy to deform the gel in other ways than buckling, and the very nature of gels will help the cushions of the present invention absorb shocks and attenuate vibrations. Thus, the ribbed gel cushions of the present invention are excellent for one, two, or even all three of the desirable cushioning attributes of (1) pressure equalization and/or redistribution, (2) shear relief, and (3) shock absorption/vibration attenuation. In addition, the ribbed gel cushions can provide (4) support and (5) alignment. For example, in a mattress, the gel members (ribs) under the most protruding body parts (e.g., hips and shoulders) can buckle, or substantially move or deform, while the gel members under the least protruding body parts hold firm without buckling (the pressure buckling threshold has not been reached) or substantially moving or deforming. The torso is supported, while the back stays aligned (all while eliminating pressure hot spots). If the hips and shoulders were not allowed to sink in, and the torso was not supported, the torso/spine would have to bend to fully reach the mattress.

Thus, unlike mattresses such as firm innerspring mattresses, a mattress comprising ribbed gel can have no excessive pressure points and can keep the spine aligned during sleep. The result can be less tossing and turning and less likelihood of back or neck pain. A shoe insole can act in a similar fashion but on a smaller scale. The foot pressures can tend toward equalization via buckling, movement, or deformation at the protruding parts of the foot, such as the heel strike area or the ball of the foot (especially advantageous for people with hammertoes), and can greatly reduce shear that might otherwise cause blisters via the outer part of the rib 10 being allowed to stretch away from the hot spot, all while maintaining overall stability via the inner part of each rib 10 being connected to the layer 12, 14 below at multiple fused points.

By way of example only and without limitation, ribbed gel can be used in the following products: sleeping pads, mattresses, toppers, pillows (bed, sofa, positioners), shoes and boots (footwear), insoles, sock liners (ankle cushion, cuff cushion), futons, zabutons, furniture (sofa, loveseat, recliner, ottoman, upholstered chairs, office chairs, medical chairs), theater seating, side chairs, patio and lawn furniture, stadium seats, wheelchair cushions (seat, back, arm, knee, head support), massage tables, exam tables, carpet pads, strap cushions (backpack, fanny pack, golf bag, purse, bra, luggage, briefcase, computer case, aftermarket/generic), saddle straps, straps of various kinds (horses, climbing, parachute, safety/industrial), automotive and motorcycle/ATV (seating, trim, headliners, panels), boats (seating, trim, headliners, panels), aircraft (seating, trim, headliners, panels), tool handles, appliance handles, packaging, top of saddle seat cushion, saddle blankets, hoof pads, cushions (neck, seat, knee, between knee, knee pads, back, lumbar), tumbling/vault pads, other athletic pads (yoga, martial arts, trampoline border pads), protective equipment (sparring, shin, shoulder, wrist, ankle, knee, elbow, hip, helmet, neck, kidney, gloves), medical positioners (surgical positioners, medical positioning cushions, orthotics, braces, slings), pads for casts for broken bones and other immobilization purposes, floor cushion for standing, bicycle (seat cushion, handle bar, gloves, saddles, shorts), martial arts mannequins, computer (mouse pad, keyboard/wrist), equipment protective bags and cases for computers, cameras, and other equipment, livestock pads (barn, trailer), pet beds, shock absorption, vibration attenuation, gurney, stretcher, hammock, toys, baby products (highchair, crib, carrier, car seat, teething, stroller, bassinet), tree collars, any automotive, equipment, boating or recreational vehicle cushions or padding, shipping containers for fragile products, all bedding, furniture and footwear products, infant goods that contact the infant, any medical products that contact the human body, and sporting goods of all types, and any other products requiring cushioning characteristics including, without limitation, pressure relief, shock absorption or vibration attenuation.

The process for making ribbed gel can be any process that results in any of the specified configuration varieties made with the any of the specified material options. Thus, the following are only examples:

Molding Generally

Ribbed gel can be molded by cutting the top pattern 12 into one plate and the bottom pattern 14 into another plate, then putting the two plates together and pressure-casting or injection-molding the gel. Fabric 13 can be put at the interface before closing the molds. Such a fabric 13 must be sufficiently porous to allow the molten gel to go through it and to leave sufficient integral contact between the two layers 12, 14 for structural purposes. The two mold plates are taken apart after the gel solidifies and the gel is removed.

Injection Molding

Because the preferred gels are thermoplastic in nature, they lend themselves well to injection molding. A mold is made by means known in the art with cavities that are filled by a standard injection molding process. The material is cooled, the mold is opened, and the part is ejected from or pulled out of the mold. Often with the preferred gels, they are at such a low durometer and have such excellent conforming properties that the gel forms to the ejector pins as the pins are thrust into the mold cavity, so that the part does not eject. Thus, many times injection molds are not designed with ejector pins but are designed to have the operator manually pull out the gel product. One advantage to injection molding with the preferred gels is that when pulled, the Poisson's effect dramatically reduces the cross-sectional thickness, so the gel comes out without the need for a draft angle on the cavity surfaces, and can even come out if the cavity has undercuts.

Compression Molding

Many of the gel devices can be compression molded. For example, an extruded sheet of gel can be placed between two open-faced molds that contain cavities in which the gel members (ribs 10) are to be formed, the cavities in one mold being placed at an angle to the cavities in the other mold. The molds are either hot to begin with or are heated, and compressive pressure is applied to the sheet in the direction of the cavities by squeezing the mold together. The gel melts and flows under this pressure into the cavities, the molds and gel are cooled, the molds are moved apart from one another, and the ribbed gel is removed. The material is integral at the joints between the ribs 10. If desired, a porous fabric 13 can be placed on one side of the extruded gel sheet before applying the mold pressure and would, thus, then be at the interface between the two layers 12, 14.

With any of these processes or other processes that would result in the desired configuration, the resulting assembly of ribbed gel can be utilized as a cushion or as a cushioning element within a cushion. The fused-fabric alternatives described herein are especially adapted to be bonded to other cushioning elements to make a composite cushion. For example, they can be easily glued to foam or they can be glued to an insulator fabric that is bonded or fastened to an inner-spring mattress unit. Alternatively, they can be glued to an EVA mid-sole in footwear or they can be bonded directly to a cover. Covers can also be applied without bonding including, without limitation, by slip-over, by zipper closure, or by hook-and-loop closure, or by no closure.

While the present invention has been described and illustrated in conjunction with a number of specific embodiments, those skilled in the art will appreciate that variations and modifications may be made without departing from the principles of the invention as herein illustrated, described, and claimed. The present invention may be embodied in other specific forms without departing from its spirit or essential characteristics. The described embodiments are to be considered in all respects as only illustrative and not restrictive. All changes that come within the meaning and range of equivalency of the claims are to be embraced within their scope.

The invention claimed is:

1. A ribbed gel cushioning member comprising:

a first ribbed gel cushioning element having a plurality of first elongated element ribs extending continuously and longitudinally in a first direction in an undeformed condition, the first direction oriented parallel to a major plane of the ribbed gel cushioning member, at least some of the first element ribs being capable of deforming under a load; and a second ribbed gel cushioning element disposed adjacent to the first ribbed gel cushioning element and having a plurality of second elongated element ribs extending continuously and longitudinally in a second direction in an undeformed condition, the second direction oriented parallel to a major plane of the ribbed gel cushioning member, the second direction oriented at an angle relative to the first direction other than parallel, at least some of the second element ribs being capable of deforming under a load, at least some of the first element ribs and at least some of the second element ribs comprising an elastomeric gel;

wherein the first ribbed gel cushioning element and the second ribbed gel cushioning element are integrally formed with one another such that the first ribbed gel cushioning element and the second ribbed gel cushioning element comprise regions of a single unitary body, each elongated element rib of the plurality of first elongated element ribs integrally adjoining at least one elongated element rib of the plurality of second elongated element ribs over a generally planar area in a plane of intersection between the first ribbed gel cushioning element and the second ribbed gel cushioning element, the generally planar area defined by a width of each of the integrally adjoining elongated element ribs of the plurality of first elongated element ribs and the at least one elongated element rib of the plurality of second elongated element ribs.

2. The ribbed gel cushioning member of claim 1, wherein the first elongated element ribs are configured to buckle at a first load, and the second elongated element ribs are configured to buckle at a second load differing from the first load.

3. The ribbed gel cushioning member of claim 1, wherein the first elongated element ribs comprise a first gel having a first hardness, and the second elongated element ribs comprise a second gel having a second hardness differing from the first hardness.

4. The ribbed gel cushioning member of claim 1, further comprising fabric disposed between the first ribbed gel cushioning element and the second ribbed gel cushioning element, the fabric connected to each of the first ribbed gel cushioning element and the second ribbed gel cushioning element.

5. The ribbed gel cushioning member of claim 1, wherein the first ribbed gel cushioning element and the second ribbed gel cushioning element differ in at least one of length, width, and height.

6. The ribbed gel cushioning member of claim 1, wherein at least one elongated element rib of the first elongated element ribs has a thickness differing from a thickness of at least one elongated element rib of the second elongated element ribs.

7. The ribbed gel cushioning member of claim 1, wherein the first elongated element ribs and the second elongated element ribs are configured to buckle at a load, and wherein the first elongated element ribs and the second elongated element ribs are configured such that buckling of an elongated element rib of the first elongated element ribs and the second elongated element ribs causes a reduction in load carrying ability of the elongated element rib of the first elongated element ribs and the second elongated element ribs.

8. The ribbed gel cushioning member of claim 1, wherein each of a gel of the first ribbed gel cushioning element and a gel of the second ribbed gel cushioning element comprises a solid elastomer extended by at least 20 parts of a plasticizer per 100 parts of the solid elastomer by weight.

9. The ribbed cushioning member of claim 8, wherein the solid elastomer of each of the gel of the first ribbed gel cushioning element and the gel of the second ribbed gel cushioning element is independently selected from SEEPS polymers, SEBS polymers, and SEPS polymers.

10. The ribbed gel cushioning member of claim 9, wherein the second direction is oriented at an angle of about 90° relative to the first direction.

11. The ribbed gel cushioning member of claim 10, wherein the first elongated element ribs comprise a first gel having a first hardness, and the second elongated element ribs comprise a second gel having a second hardness differing from the first hardness.

12. The ribbed gel cushioning member of claim 11, wherein the first elongated element ribs extend at least substantially parallel to one another from one side of the first ribbed gel cushioning element to another side of the first ribbed gel cushioning element.

13. The ribbed gel cushioning member of claim 1, wherein the first elongated element ribs extend at least substantially parallel to one another from one side of the first ribbed gel cushioning element to another side of the first ribbed gel cushioning element.

14. The ribbed gel cushioning member of claim 13, wherein each of a gel of the first ribbed gel cushioning element and a gel of the second ribbed gel cushioning element comprises a solid elastomer extended by at least 20 parts of a plasticizer per 100 parts of the solid elastomer by weight.

15. The ribbed cushioning member of claim 14, wherein the solid elastomer of each of the gel of the first ribbed gel cushioning element and the gel of the second ribbed gel cushioning element is independently selected from SEEPS polymers, SEBS polymers, and SEPS polymers.

16. The ribbed gel cushioning member of claim 15, wherein the first elongated element ribs comprise a first gel having a first hardness, and the second elongated element ribs comprise a second gel having a second hardness differing from the first hardness.

17. The ribbed cushioning member of claim 16, wherein the first elongated element ribs and the second elongated element ribs are oriented at about 90° relative to one another.

18. The ribbed gel cushioning member of claim 13, wherein the first elongated element ribs comprise a first gel having a first hardness, and the second elongated element ribs comprise a second gel having a second hardness differing from the first hardness.

* * * * *